US011817244B2

(12) United States Patent
Inoue et al.

(10) Patent No.: US 11,817,244 B2
(45) Date of Patent: Nov. 14, 2023

(54) METHOD FOR MANUFACTURING ELECTRONIC COMPONENT

(71) Applicant: Murata Manufacturing Co., Ltd., Kyoto-fu (JP)

(72) Inventors: Mitsunori Inoue, Nagaokakyo (JP); Hironobu Kubota, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 368 days.

(21) Appl. No.: 17/102,192

(22) Filed: Nov. 23, 2020

(65) Prior Publication Data

US 2021/0101210 A1 Apr. 8, 2021

Related U.S. Application Data

(62) Division of application No. 15/070,801, filed on Mar. 15, 2016, now Pat. No. 10,875,095.

(30) Foreign Application Priority Data

Mar. 19, 2015 (JP) ..... 2015-056779
Jan. 8, 2016 (JP) ..... 2016-002417

(51) Int. Cl.
*H01F 7/06* (2006.01)
*H01F 17/00* (2006.01)
(Continued)

(52) U.S. Cl.
CPC ..... *H01F 17/0013* (2013.01); *B22F 7/04* (2013.01); *B22F 7/08* (2013.01); *H01F 17/0033* (2013.01);
(Continued)

(58) Field of Classification Search
CPC ..... H01F 17/0013; H01F 17/0033; H01F 27/292; H01F 41/0246; H01F 41/046;
(Continued)

(56) References Cited

U.S. PATENT DOCUMENTS 3,425,666 A 2/1969 Lindquist et al.
6,214,685 B1 4/2001 Clinton et al.
(Continued)

FOREIGN PATENT DOCUMENTS

CN 102917818 A 2/2013
JP 2003145034 A 5/2003
(Continued)

OTHER PUBLICATIONS

Office Action mailed by the Japanese Patent Office dated Aug. 28, 2018, which corresponds to Japanese Patent Application No. 2016-002417 and is related to U.S. Appl. No. 15/070,801.
(Continued)

*Primary Examiner* — Paul D Kim
(74) *Attorney, Agent, or Firm* — Studebaker & Brackett PC

(57) ABSTRACT

An electronic component includes a body made of an insulator, a coating film covering the body, a conductor located in the body, and outer electrodes each of which is connected to the conductor. The insulator contains a magnetic metal powder. The coating film is composed of resin and cations of a metal which is a cationic element contained in the insulator and which has a standard electrode potential E0 of less than about 0 V.

6 Claims, 3 Drawing Sheets

(51) Int. Cl.

| | |
|---|---|
| ***B22F 7/04*** | (2006.01) |
| ***H01F 27/29*** | (2006.01) |
| ***B22F 7/08*** | (2006.01) |
| ***H01F 41/04*** | (2006.01) |
| *H01F 41/02* | (2006.01) |
| *C22C 33/02* | (2006.01) |
| *B22F 1/102* | (2022.01) |
| *B22F 1/00* | (2022.01) |

(52) U.S. Cl.
CPC ..... *H01F 27/292* (2013.01); *H01F 41/046* (2013.01); *B22F 1/09* (2022.01); *B22F 1/102* (2022.01); *B22F 2007/045* (2013.01); *B22F 2999/00* (2013.01); *C22C 33/02* (2013.01); *H01F 41/0246* (2013.01)

(58) Field of Classification Search
CPC ..... B22F 7/04; B22F 7/08; B22F 2007/045; B22F 1/0003; B22F 1/102; B22F 2999/00; C22C 33/02
See application file for complete search history.

(56) References Cited

U.S. PATENT DOCUMENTS

| | | | | |
|---|---|---|---|---|
| 11,120,934 | B2 * | 9/2021 | Kubota | H01F 17/04 |
| 2001/0035810 | A1 | 11/2001 | Heistand et al. | |
| 2002/0050909 | A1 | 5/2002 | Jinno et al. | |
| 2003/0134133 | A1 | 7/2003 | Kimura et al. | |
| 2003/0150741 | A1 | 8/2003 | Wu | |
| 2003/0230362 | A1 | 12/2003 | Tajima et al. | |
| 2004/0161600 | A1 * | 8/2004 | Igarashi | H01F 41/0246 428/328 |
| 2004/0169267 | A1 | 9/2004 | Matsuoka et al. | |
| 2005/0229388 | A1 | 10/2005 | Deng et al. | |
| 2007/0252771 | A1 | 11/2007 | Maezawa et al. | |
| 2008/0226899 | A1 | 9/2008 | Suetsuna et al. | |
| 2008/0283188 | A1 * | 11/2008 | Oda | C01G 53/006 524/435 |
| 2012/0018205 | A1 | 1/2012 | Sato et al. | |
| 2013/0057371 | A1 | 3/2013 | Shimoyama et al. | |
| 2013/0084502 | A1 | 4/2013 | Singh et al. | |
| 2013/0222101 | A1 | 8/2013 | Ito et al. | |
| 2015/0325369 | A1 | 11/2015 | Inoue et al. | |
| 2017/0200487 | A1 | 7/2017 | Kim et al. | |

FOREIGN PATENT DOCUMENTS

| | | | |
|---|---|---|---|
| JP | 2010186909 | A | 8/2010 |
| JP | 2011204778 | A | 10/2011 |
| JP | 2011249615 | A | 12/2011 |
| JP | 2013225718 | A | 10/2013 |
| JP | 2014130988 | A | 7/2014 |
| WO | 2014119564 | A1 | 8/2014 |

OTHER PUBLICATIONS

Office Action mailed by the Japanese Patent Office dated Apr. 2, 2018, which corresponds to Japanese Patent Application No. 2016-002417 and is related to U.S. Appl. No. 15/070,801.

Notification of the Second Office Action issued by the State Intellectual Property Office of the People's Republic of China dated Nov. 16, 2017, which corresponds to Chinese Patent Application No. 201610157007.3 and is related to U.S. Appl. No. 15/070,801.

M. Yanagi, K. Karube, A. Suda, "Deposition Mechanism of Self-deposition Coating System", Journal of the Surface Finishing Society of Japan, 1999, pp. 559-564, vol. 50, No. 6, Japan.

* cited by examiner

METHOD FOR MANUFACTURING ELECTRONIC COMPONENT

CROSS REFERENCE TO RELATED APPLICATIONS

This application is a Divisional of U.S. patent application Ser. No. 15/070,801 filed Mar. 15, 2016, now U.S. Pat. No. 10,875,095, which claims benefit of priority to Japanese Patent Application 2015-056779 filed Mar. 19, 2015, and to Japanese Patent Application No. 2016-002417 filed Jan. 8, 2016, the entire content of which is incorporated herein by reference.

TECHNICAL FIELD

The present disclosure relates to electronic components and method for manufacturing the electronic components. The present disclosure particularly relates to an electronic component including an insulator containing a magnetic metal powder and a method for manufacturing the electronic component.

BACKGROUND

Japanese Unexamined Patent Application Publication No. 2013-225718 discloses a coil component, which is known as an electronic component including an insulator containing a magnetic metal powder. In this type of electronic component (hereinafter referred to as the known electronic component), an internal circuit element is covered with an insulator containing a magnetic metal powder. For the known electronic component, chemical conversion is performed using a phosphate for the purpose of preventing the rusting of the magnetic metal powder, which is contained in the insulator. However, a coating film formed by the chemical conversion of the phosphate is generally thin and is insufficient in moisture resistance, chemical resistance, and the like for the quality of the coating film that is required for an electronic component.

SUMMARY

It is an object of the present disclosure to provide an electronic component including an insulator containing a magnetic metal powder and a resin coating film placed on the insulator. It is another object of the present disclosure to provide a method for manufacturing the electronic component.

An electronic component according to an embodiment of the present disclosure includes a body made of an insulator, a coating film covering the body, a conductor located in the body, and outer electrodes each of which is connected to the conductor. The insulator contains a magnetic metal powder. The coating film is composed of resin and cations of a metal which is a cationic element contained in the insulator and which has a standard electrode potential E0 of less than about 0 V.

In the electronic component, the metal having a standard electrode potential E0 of less than about 0 V preferably includes at least one selected from the group consisting of Sn, Cr, Fe, Zn, Mn, Al, Mg, Ca, Ba, K, and Li.

In the electronic component, the metal having a standard electrode potential E0 of less than about 0 V preferably includes at least one selected from the group consisting of Sn, Cr, Zn, Mn, Al, Mg, Ca, Ba, K, and Li in addition to Fe.

In the electronic component, the insulator preferably contains a first powder which is the magnetic metal powder and which contains Fe and a second powder containing at least one selected from the group consisting of Sn, Cr, Zn, Mn, Al, Mg, Ca, Ba, K, and Li.

In the electronic component, it is preferable that the magnetic metal powder contains particles covered by a coating and the coating contains at least one selected from the group consisting of Sn, Cr, Zn, Mn, Al, Mg, Ca, Ba, K, and Li.

In the electronic component, the magnetic metal powder is preferably a powder of an alloy or solid solution of Fe with at least one selected from the group consisting of Sn, Cr, Zn, Mn, Al, Mg, Ca, Ba, K, and Li.

In the electronic component, the conductor is made of a metal having a standard electrode potential E0 of about 0 V or more. The metal having a standard electrode potential E0 of about 0 V or more may be one or more selected from the group consisting of Cu, Ag, Pt, and Au.

A method for manufacturing an electronic component includes a step of preparing a body which is formed from a magnetic metal powder containing a metal having a standard electrode potential E0 of less than about 0 V and an insulator containing an insulating resin and which includes a conductor located in the insulator; a step of preparing a mixed solution containing an ionizing component ionizing the metal contained in the magnetic metal powder, a surfactant, and a resin component; and a step of applying the mixed solution to the body and drying the body.

In accordance with an electronic component according to an embodiment of the present disclosure, a coating film covering a body is composed of resin and cations of a metal which is a cationic element contained in a metal powder contained in an insulator and which has a standard electrode potential E0 of less than about 0 V and therefore is thicker than a coating film formed by the chemical conversion of a phosphate. The electronic component is excellent in abrasion resistance, insulation performance, moisture resistance, and chemical resistance.

In accordance with the electronic component, the coating film covering the body is composed of resin and the metal which is the cationic element contained in the metal powder contained in the insulator and which has a standard electrode potential E0 of less than about 0 V. The cationic element is ionized into cations from the metal powder contained in the insulator. Therefore, even in the case where insulating coatings attached to particles in the metal powder are peeled off in a grinding step or the like, the cationic element is dissolved from the metal powder in a subsequent step in the form of cations, which form the coating film. As a result, the coil component is excellent in insulation performance and rust resistance.

In accordance with the electronic component, when Fe contained in the insulator and the metal having a standard electrode potential E0 of less than about 0 V are separately present, that is, when a resin formation reaction due to an Fe-containing material (first powder) used in a magnetic metal body is insufficient, a readily ionizable metal (second powder) may be added so as to act as a forming aid.

When Fe contained in the insulator and the metal having a standard electrode potential E0 of less than about 0 V are separately present (that is, when the insulator contains the first powder, which is a magnetic metal powder, and the second powder), the insulator contains a powder of a metal other than Fe, leading to the reduction of the content of Fe as a magnetic material. When the surfaces of particles of Fe contained in the insulator are coated with the metal having a standard electrode potential E0 of less than about 0 V (that is, coatings are present on the surfaces of particles in the magnetic metal powder and the coatings contain at least one selected from the group consisting of Sn, Cr, Zn, Mn, Al, Mg, Ca, Ba, K, and Li) or the metal having a standard electrode potential E0 of less than about 0 V is present in the form of an alloy or solid solution of Fe contained in the insulator with the metal having a standard electrode potential E0 of less than about 0 V (that is, the magnetic metal powder is a powder of an alloy or solid solution containing Fe and at least one selected from the group consisting of Sn, Cr, Zn, Mn, Al, Mg, Ca, Ba, K, and Li), a highly ionic metal is added to Fe so as to act as a forming aid without reducing the content of a magnetic material.

That is, the reduction of the Fe content of the insulator is suppressed, the reduction of magnetic properties of the insulator is suppressed, and the coating film is likely to be formed.

According to preferred embodiments of the present disclosure, in an electronic component including an insulator containing a magnetic metal powder, a resin coating film can be formed on the insulator. The electronic component is excellent in moisture resistance and chemical resistance. A method for manufacturing the electronic component can be achieved.

Other features, elements, characteristics and advantages of the present disclosure will become more apparent from the following detailed description of preferred embodiments of the present disclosure with reference to the attached drawings.

DETAILED DESCRIPTION

An electronic component according to an embodiment of the present disclosure and a method for manufacturing the electronic component are described below.

1. Electronic Component

Figure 1:
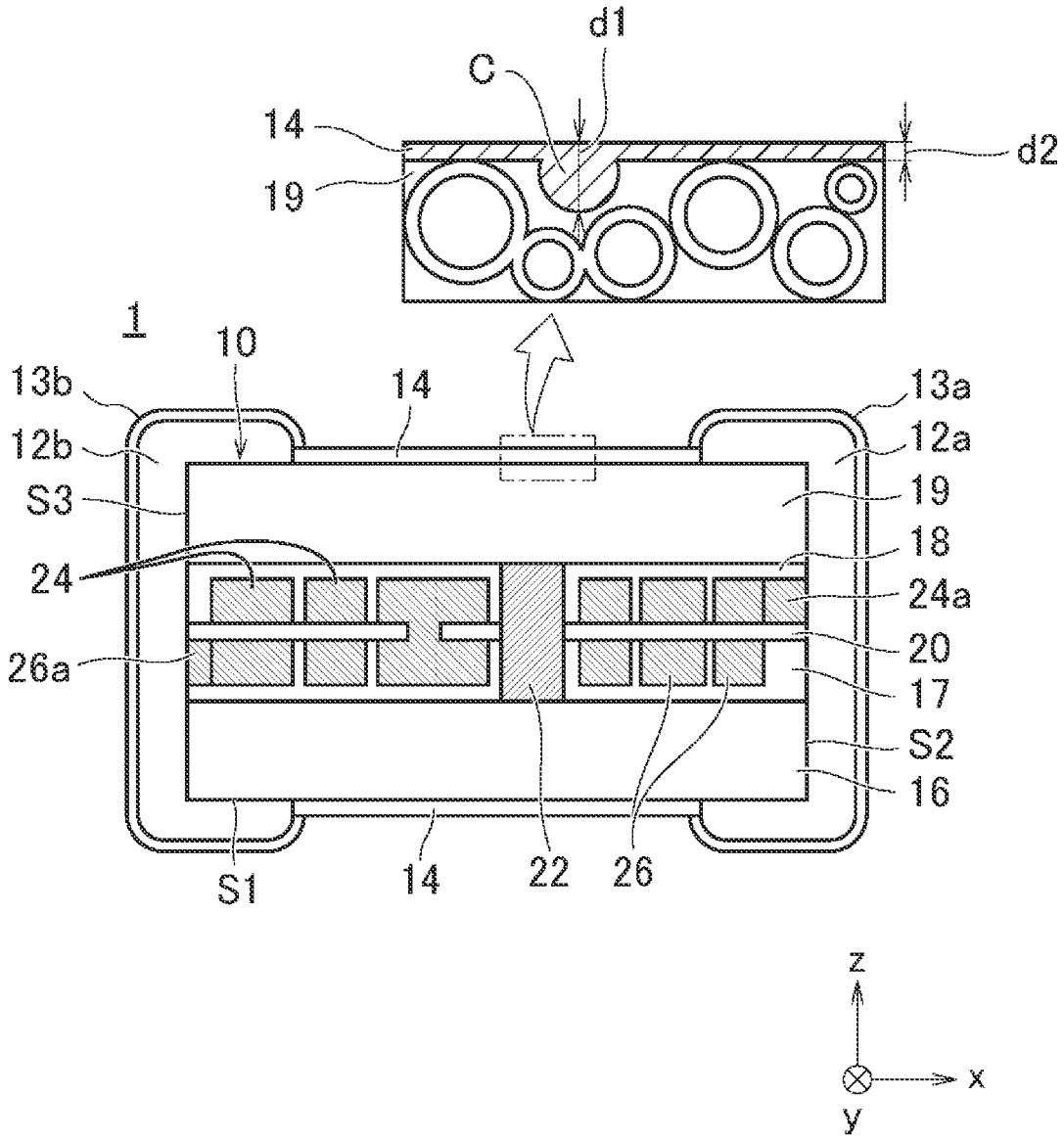
FIG. 1 is a schematic sectional view of a coil component which is an example of an electronic component according to an embodiment of the present disclosure.

The electronic component is described with reference to FIG. 1. FIG. 1 is a schematic sectional view of a coil component 1 which is an example of the electronic component. In FIG. 1, a direction orthogonal to a bottom surface S1 of the coil component 1 is defined as a z-axis direction. That is, the bottom surface S1 of the coil component 1 is located in the negative direction of a z-axis. When viewed from above in the z-axis direction, a direction along a long side of the coil component 1 is defined as an x-axis direction and a direction along a short side of the coil component 1 is defined as a y-axis direction. An x-axis, a y-axis, and the z-axis are orthogonal to each other.

A surface of the coil component 1 that is located in the positive direction of the x-axis is defined as a side surface S2. A surface of the coil component 1 that is located in the negative direction of the x-axis is defined as a side surface S3.

As shown in FIG. 1, the coil component 1 includes a body 10, outer electrodes 12*a* and 12*b*, and a coating film 14 covering the body 10. The body 10 is substantially cuboid-shaped.

As shown in FIG. 1, the body 10 includes insulating layers 16 to 19, an insulating board 20, a flux path 22, and coils 24 and 26 serving as conductive portions and connected to each other to serve as a coil (namely, a conductor). In the body 10, the insulating layers 16 and 17, the insulating board 20, and the insulating layers 18 and 19 are stacked in that order from the negative direction to positive direction of the z-axis.

The insulating layers 16 and 19 are made of an epoxy resin containing a magnetic metal powder or the like. In this embodiment, the magnetic metal powder contains a metal having a standard electrode potential E0 of less than about 0 V. The metal having a standard electrode potential E0 of less than about 0 V includes at least one selected from the group consisting of Sn, Cr, Fe, Zn, Mn, Al, Mg, Ca, Ba, K, and Li. The magnetic metal powder may be, for example, an Fe powder, a powder of an Fe alloy, or an amorphous powder containing Fe. The Fe alloy is, for example, an Fe—Si alloy, an Fe—Si—Cr alloy, or an Fe—Si—Al alloy. In this embodiment, the insulating layers and 19 may contain two types of magnetic metal powders different in particle size in order to increase the density of the magnetic metal powders in the insulating layers 16 and 19. In particular, the insulating layers 16 and 19 may contain, for example, a mixture of a magnetic powder which has an average particle size of about 80 μm and a maximum particle size of about 100 μm and which is composed of an Fe—Si—Cr alloy and a magnetic powder which has an average particle size of about 3 μm and which is composed of carbonyl iron. In consideration of the L-value and direct-current superposition characteristics of the coil component 1, the insulating layers 16 and 19 contain, for example, about 90% by weight or more of the magnetic metal powder. The insulating layers 16 and 19 may contain resin, an insulating inorganic material such as a glass ceramic, a polyimide resin, or the like.

The insulating layer 16 is located in an end portion of the body 10 in the negative direction of the z-axis. The bottom surface S1 is a surface of the insulating layer 16 that is located in the negative direction of the z-axis and serves as a mounting surface when the coil component 1 is mounted on a circuit board. The insulating layer 19 is located in an end portion of the body 10 in the positive direction of the z-axis. The insulating layers 16 and 19 have a thickness of, for example, about 60 μm. The thickness of the insulating layers 16 and 19 is less than the maximum particle size of the magnetic metal powder.

The insulating layers 17 and 18 are made of an epoxy resin or the like. The insulating layer 17 is located in the positive direction of the z-axis with respect to the insulating layer 16. The insulating layer 18 is located in the negative direction of the z-axis with respect to the insulating layer 19. Incidentally, the insulating layers 17 and 18 may be made of an insulating resin such as polybenzodichlorobutene or an insulating inorganic material such as a glass ceramic.

The insulating board 20 is a printed circuit board including a glass cloth impregnated with an epoxy resin and is interposed between the insulating layers 17 and 18 in the z-axis direction. The insulating board 20 may be made of an insulating resin such as polybenzodichlorobutene or an insulating inorganic material such as a glass ceramic.

The flux path 22 is placed in the body 10, is located at substantially the center of the body 10, and is made of a resin containing a magnetic powder. In this embodiment, in consideration of the L-value and direct-current superposition characteristics of the coil component 1, the flux path 22 contains about 90% by weight or more of the magnetic powder. In order to increase the filling factor in the flux path 22, the magnetic powder is a mixture of two types of powders different in particle size. The flux path 22 extends through the insulating layers 17 and 18 and the insulating board 20 in the z-axis direction and forms, for example, an oval pillar. The flux path 22 is located inside coils 24 and 26 below.

As shown in FIG. 1, surfaces of the body 10, that is, surfaces of the insulating layers 16 and 19 are covered with the coating film 14 and the magnetic metal powder (metal powder) exposed on the surfaces. The coating film 14 contains a cationic element contained in the magnetic metal powder contained in the insulating layers 16 and 19 and resin. In the coil component 1, the coating film 14 is not present between the insulating layers 16 and 19 and outer electrodes 12*a* and 12*b* below as shown in FIG. 1.

The cationic element, which is contained in the coating film 14, is one which is dissolved from portions of the insulating layers 16 and 19 and which is deposited. In particular, the cationic element is the metal having a standard electrode potential E0 of less than about 0 V. The metal having a standard electrode potential E0 of less than about 0 V includes at least one selected from the group consisting of Sn, Cr, Fe, Zn, Mn, Al, Mg, Ca, Ba, K, and Li.

Furthermore, Fe contained in the insulating layers 16 and 19 and the metal having a standard electrode potential E0 of less than about 0 V may be separately present. The metal having a standard electrode potential E0 of less than about 0 V may be present in such a state that the metal having a standard electrode potential E0 of less than about 0 V coats the surfaces of particles of Fe contained in the insulating layers 16 and 19. Alternatively, Fe contained in the insulating layers 16 and 19 and the metal having a standard electrode potential E0 of less than about 0 V may be present in the form of an alloy or a solid solution.

When Fe contained in the insulating layers 16 and 19 and the metal having a standard electrode potential E0 of less than about 0 V are separately present, that is, when a resin formation reaction due to an Fe-containing material used in a magnetic metal body is insufficient, a readily ionizable metal may be added so as to act as a forming aid.

In particular, the magnetic metal powder, which is contained in the insulating layers 16 and 19, is preferably a mixture of a first powder containing Fe and a second powder containing at least one selected from the group consisting of Sn, Cr, Zn, Mn, Al, Mg, Ca, Ba, K, and Li. The metal contained in the second powder has a standard electrode potential E0 of less than about 0 V and is readily ionizable. Therefore, when the insulating layers 16 and 19 contain the second powder in addition to the first powder, the insulating layers 16 and 19 contain a larger amount of a metal which has a low standard electrode potential E0 and which is readily ionizable; hence, the coating film 14 is readily formed. The metal contained in the second powder is more preferably selected from the group consisting of Cr, Zn, Mn, Al, Mg, Ca, Ba, K, and Li, which are lower in standard electrode potential E0 than Fe.

The magnetic metal powder preferably contains particles of each surface-covered by a coating. The coating preferably contains at least one selected from the group consisting of Sn, Cr, Zn, Mn, Al, Mg, Ca, Ba, K, and Li. In this case, the metal which has a low standard electrode potential E0 and which is readily ionizable is present on the surfaces of the particles. Therefore, the coating film 14 is readily formed so as to cover the body 10 when a resin emulsion containing an ionizing component (etching agent) is applied to the body 10. The coating more preferably contains at least one selected from the group consisting of Cr, Zn, Mn, Al, Mg, Ca, Ba, K, and Li, which are lower in standard electrode potential E0 than Fe.

The magnetic metal powder is preferably a powder of an alloy or solid solution of Fe with at least one selected from the group consisting of Sn, Cr, Zn, Mn, Al, Mg, Ca, Ba, K, and Li. In this case, the magnetic metal powder contains such a readily ionizable metal in addition to Fe. Therefore, the coating film 14 is readily formed so as to cover the body 10 when the resin emulsion, which contains the ionizing component (etching agent), is applied to the body 10. The magnetic metal powder is more preferably a powder of an alloy or solid solution of Fe with at least one selected from the group consisting of Cr, Zn, Mn, Al, Mg, Ca, Ba, K, and Li, which are lower in standard electrode potential E0 than Fe.

When Fe and the metal having a standard electrode potential E0 of less than about 0 V are separately present in the insulating layers 16 and 19, the insulating layers 16 and 19 contain a powder of a metal other than Fe, leading to the reduction of the content of Fe as a magnetic material. When the surfaces of particles of Fe contained in the insulating layers 16 and 19 are coated with the metal having a standard electrode potential E0 of less than about 0 V or the metal having a standard electrode potential E0 of less than about 0 V is present in the form of an alloy or solid solution of Fe contained in the insulating layers 16 and 19 with the metal having a standard electrode potential E0 of less than about 0 V, a highly ionic metal may be added to Fe so as to act as a forming aid without reducing the content of a magnetic material.

The resin contained in the coating film 14 is, for example, an acrylic resin. The acrylic resin has a cross-linked structure. The resin contained in the coating film 14 may be an epoxy resin, a polyimide resin, a silicone resin, a polyamide-imide resin, a polyether ether ketone resin, a fluorinated resin, an acrylic silicone resin, or the like other than the acrylic resin. Other examples of the resin contained in the coating film 14 include polymer resins produced from one or more selected from the group consisting of methyl acrylate, ethyl acrylate, n-butyl acrylate, 2-hydroxyethyl acrylate, 2-hydroxypropyl acrylate, 2-ethylhexyl acrylate, methyl methacrylate, ethyl methacrylate, n-butyl methacrylate, 2-hydroxyethyl methacrylate, 2-hydroxypropyl methacrylate, glycidyl acrylate, glycidyl methacrylate, acrylamide, methacrylamide, acrylonitrile, styrene, ethylene, butadiene, vinyl chloride, vinylidene chloride, vinyl acetate, acrylic acid, and methacrylic acid. The resin contained in the coating film 14 may contain a polymerization initiator, such as ammonium persulfate, potassium persulfate, or t-butyl hydroperoxide, for obtaining the resin contained in the coating film 14. This does not particularly affect properties of the coating film 14.

In consideration of using solder to mount the coil component 1 on a circuit board, the coating film 14 preferably has high pyrolysis temperature. The pyrolysis temperature of the coating film 14 is, for example, about 240° C. or higher, where the pyrolysis temperature is defined as a temperature at which the mass of the resin contained in the coating film 14 is reduced by about 5%. The pyrolysis temperature can be measured under analytical conditions below using an analyzer below.

Analyzer: TG-DTA 2000SA (available from NETZSCH Japan K.K.)

Analytical conditions

Temperature profile: room temperature to about 300° C. (about 10 ° C/min)

Measurement atmosphere: vacuum (evacuated to about 0.1 Pa using a rotary pump)

Sample cell material: Al

Sample weight: about 100 mg

An example of a technique for identifying ions (cations) of elements contained in the magnetic metal powder is X-ray photoelectron spectroscopy (XPS). XPS measurement conditions are as described below.

Measurement system: PHI 5000 VersaProbe available from Ulvac-Phi Inc.

X-ray source: Al Kα radiation

Measurement area: about 100 μmφ

X-ray acceleration energy: about 93.9 eV

Time per measurement step: about 100 ms

Number of Fe 2p layers: about 500

Energy compensation: C 1 s=about284.6 eV

In the case where the coating film 14 is analyzed by XPS, a peak, at about 710 eV, indicating the presence of Fe cations can be observed in an Fe 2p3 spectrum. However, a peak, at about 707 eV, indicating the presence of metallic Fe (Fe in a metal state) is not observed. This enables the presence of ions (cations) of an element contained in the magnetic metal powder, which is contained in the coating film 14, to be proved.

The coating film 14 extends in recessed portions C formed by the removal of the magnetic powder, which is contained in the insulating layers 16 and 19, from the insulating layers 16 and 19 to substantially fill the recessed portions C. As a result, the thickness d1 of a portion of the coating film 14 that extends in each recessed portion C is greater than the thickness d2 of another portion of the coating film 14 that is on a surface of the body 10.

The coils 24 and 26 are located in the body 10 and are made of a conductive material such as Au, Ag, Cu, Pd, Pt, or Ni.

In this embodiment, it is preferable that the insulating layers 16 and 19 contain the metal having a standard electrode potential E0 of less than about 0 V and the coils 24 and 26 are made of a metal having a standard electrode potential higher than that of the metal having a standard electrode potential E0 of less than about 0 V. Thus, the coils 24 and 26 are preferably made of a metal having a standard electrode potential E0 of about 0 V or more. In particular, the coils 24 and 26 are preferably made of one or more metals selected from the group consisting of Cu, Ag, Pt, and Au. In this case, the metal contained in the insulating layers 16 and 19 has an ionization tendency higher than the ionization tendency of the metal contained in the coils 24 and 26. The coils 24 and 26 are located in the insulating layers 16 and 19 and have end portions exposed from the insulating layers 16 and 19. Therefore, when a mixed solution containing an ionizing component (etching component) is applied to the exposed end portions of the coils 24 and 26 and the insulating layers 16 and 19, the metal contained in the insulating layers 16 and 19 is more selectively ionized as compared to the metal contained in the coils 24 and 26, whereby cations are produced. The balance of charge is disrupted by the produced cations and therefore a resin component is unlikely to maintain an emulsion and deposits on the insulating layers 16 and 19 to form the coating film 14. In this operation, cations are unlikely to be produced from the exposed end portions of the coils 24 and 26 and therefore a coating layer (the coating film 14) can be formed so as not cover the exposed end portions of the coils 24 and 26. If the exposed end portions of the coils 24 and 26 are covered with the coating film 14, then the connection between the outer electrodes 12*a* and 12*b* and the coils 24 and 26 is weak and the direct-current resistance Rdc of the coil component 1 (electronic component) is low. In this embodiment, the exposed end portions of the coils 24 and 26 can be prevented from being covered by the coating film 14 and therefore the reduction in direct-current resistance Rdc of the coil component 1 (electronic component) can be suppressed.

The coils 24 and 26 (conductive portions) may be coil-shaped conductors or may be, for example, metal coils, coil-shaped pieces of conductive paste, or coil-shaped pieces of metal foil.

As shown in FIG. 1, the coil 24 is placed on the upper surface of the insulating board 20 and is a spiral conductor that turns clockwise to approach the center when viewed from above in the positive direction of the z-axis. The coil 24 extends to the side surface S2 of the body 10 and has an outside end 24*a* exposed in the side surface S2 of the body 10.

The coil 26 is placed on the lower surface of the insulating board 20 and is a spiral conductor that turns clockwise from the center toward outside when viewed from above in the positive direction of the z-axis. The coil 26 extends to the side surface S3 of the body 10 and has an outside end 26*a* exposed in the side surface S3 of the body 10. Furthermore, the coil 26 has an inside end that is placed so as to overlap an inside end of the coil 24 when viewed in the z-axis direction.

The outer electrode 12*a* is placed so as to cover the side surface S2 of the body 10 and portions of surfaces next to the side surface S2 thereof. The outer electrode 12*a* is electrically connected to the outside end 24*a* of the coil 24 that is exposed in the side surface S2 of the body 10. The outer electrode 12*b* is placed so as to cover the side surface S3 of the body 10 and portions of surfaces next to the side surface S3 thereof. The outer electrode 12*b* is electrically connected to the outside end 26*a* of the coil 26 that is exposed in the side surface S3 of the body 10.

The coil component 1, which is configured as described above, functions as an inductor when a signal input from the outer electrode 12*a* or 12*b* is output from the outer electrode 12*b* or 12*a*, respectively, through the coils 24 and 26.

2. Method for Manufacturing Electronic Component

Figure 2:
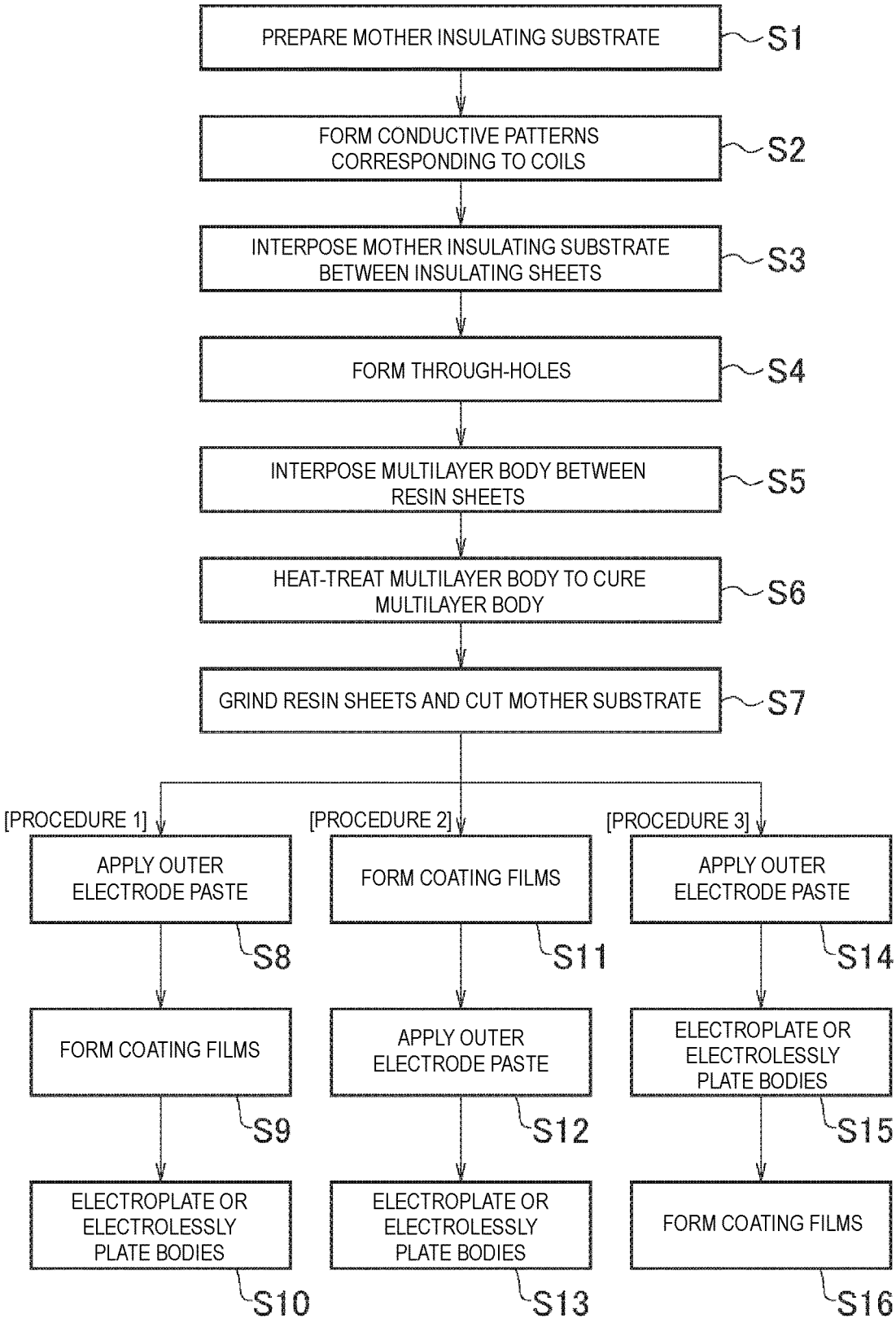
FIG. 2 is a flowchart illustrating an example of a method for manufacturing a coil component according to an embodiment of the present disclosure.

A method for manufacturing an electronic component according to an embodiment of the present disclosure is described below using a coil component as an example. FIG. 2 is a flowchart illustrating an example of a method for manufacturing a coil component 1 according to an embodiment of the present disclosure. A z-axis direction used to describe the method for manufacturing the coil component 1 is a direction orthogonal to the bottom surface of the coil component 1.

First, in Step S1, a mother insulating substrate to be divided into a plurality of insulating boards 20 is prepared. In order to increase the efficiency of obtaining an inductance, the mother insulating substrate preferably has a thickness of about 60 μm or less.

Next, in Step S2, a plurality of conductive patterns corresponding to coils 24 and 26 are formed on the upper and lower surfaces of the mother insulating substrate. After the conductive patterns are formed, the conductive patterns are plated with Cu, whereby the coils 24 and 26 are formed so as to have a sufficient thickness.

Next, in Step S3, the mother insulating substrate having the coils 24 and 26 is interposed between insulating sheets in the z-axis direction, the insulating sheets to be divided into a plurality of insulating layers 17 and 18, whereby a multilayer body is formed. A step of interposing the mother insulating substrate between the insulating sheets is preferably performed in a vacuum for the purpose of filling the insulating sheets in micro-cavities between coils. In addition, in order to suppress the generation of floating capacity due to the coils 24 and 26, the insulating sheets preferably have a relative dielectric constant of about 4 or less.

Next, in Step S4, in order to form flux paths 22, through-holes are formed by laser processing or the like so as to extend through the mother insulating substrate and the insulating sheets in the z-axis direction. Positions where the through-holes are formed are inside the coils 24 and 26, which are placed on the mother insulating substrate, in the x-y plane.

Next, in Step S5, the multilayer body, in which the insulating sheet to be divided into the insulating layers 17, the mother insulating substrate to be divided into the insulating boards 20, and the insulating sheet to be divided into the insulating layers 18 are stacked in that order, is interposed between magnetic metal powder-containing resin sheets to be divided into insulating layers 16 and 19 in the z-axis direction, as is the case with the insulating sheets to be divided into the insulating layers 17 and 18, followed by pressure bonding. In this operation, the magnetic metal powder-containing resin sheet o be divided into the insulating layers 16 is pressure-bonded to the insulating sheet to be divided into the insulating layers 17 and the magnetic metal powder-containing resin sheet o be divided into the insulating layers 19 is pressure-bonded to the insulating sheet to be divided into the insulating layers 18. The magnetic metal powder-containing resin sheets are filled in the through-holes, which are located in the multilayer body, by pressure bonding, whereby the flux paths 22 are formed.

Thereafter, in Step S6, the multilayer body interposed between the magnetic metal powder-containing resin sheets is heat-treated in a thermostatic vessel such as an oven and is thereby cured.

Next, after the multilayer body interposed between the magnetic metal powder-containing resin sheets is cured in Step S6, surfaces of the magnetic metal powder-containing resin sheets are ground by buffing or lapping or using a grinder or the like in Step S7, whereby a mother substrate that is a cluster of bodies 10 for use in a plurality of coil components 1 is completed.

Next, the mother substrate is cut with a dicer or the like, whereby the mother substrate is divided into the bodies 10. Outside ends 24*a* of the coils 24 and outside ends 26*a* of the coils 26 are exposed in cross sections of the bodies 10 by dividing the mother substrate.

Through steps subsequent to Step S7, one of Procedures 1 to 3 is used.

(a) Procedure 1

In the case of using Procedure 1, in Step S8, outer electrode paste is applied to side surfaces S2 and S3 of the bodies 10 obtained in Step S7. Thereafter, the outer electrode paste applied thereto is baked, whereby outer electrodes 12*a* and outer electrodes 12*b* are formed so as to be electrically connected to the outside ends 24*a* of the coils 24 and the outside ends 26*a* of the coils 26, respectively.

Next, in Step S9, the bodies 10 obtained in Step S7 are immersed in a mixed solution containing commercially available latex prepared by dispersing an etching component and a resin component in an aqueous solvent, an etching promoter, and a surfactant. The composition of the mixed solution is shown in the table. The immersion of the bodies 10 in the mixed solution allows surfaces of the bodies 10 to be etched. The etching of the bodies 10 is due to the action of sulfuric acid and aqueous hydrogen peroxide contained in the mixed solution. Various acids such as hydrofluoric acid, nitric acid, hydrochloric acid, phosphoric acid, and carboxylic acids may be used instead of sulfuric acid and aqueous hydrogen peroxide in the mixed solution.

TABLE 1

| Material name | Amount (ml/l) |
|---|---|
| NipolLATEX SX-1706A | 100 |
| ELEMINOL JS-2 | 35 |
| 5% Sulfuric acid | 50 |
| 30% Aqueous hydrogen peroxide | 2 |
| Pure water | 813 |

A cationic element contained in the insulating layers 16 and 19 is ionized by etching the bodies 10. The ionized cationic element reacts with the resin component contained in the latex, that is, Nipol LATEX SX-1706 (available from ZEON Corporation), in the mixed solution. As a result, the resin component in the mixed solution is neutralized and is deposited on surfaces of the bodies 10 for use in the coil components 1, whereby the bodies 10 are covered by coating films 14. The surfactant contained in the mixed solution is ELEMINOL JS-2 (available from Sanyo Chemical Industries, Ltd.) and is used to regulate the reaction of the cationic element, which is contained in the insulating layers 16 and 19, with the resin component.

Thereafter, the coating film 14 are cleaned with pure water, are drained, and are then heat-treated. The resin component contained in the coating film 14 is cross-linked with the cationic element or is cross-linked alone by the heat treatment of the coating films 14.

Figure 3:
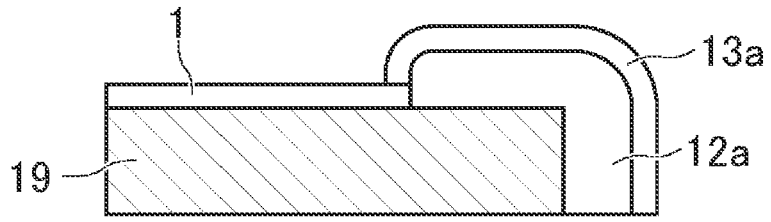
FIG. 3 is an enlarged sectional view of an outer electrode.

Next, in Step S10, plated coatings 13*a* and 13*b* are formed on the outer electrodes 12*a* and 12*b* by an electroplating or electroless plating process. The plated coatings 13*a* and 13*b* have a double structure composed of, for example, a lower Ni plating film and an upper Sn plating film. FIG. 3 is an enlarged sectional view of a section having an outer electrode 12*b* formed by Procedure 1. The coil components 1 are completed through the above steps.

(b) Procedure 2

In the case of using Procedure 2, in Step S11, the bodies 10 obtained in Step S7 are immersed in the mixed solution containing the commercially available latex prepared by dispersing the etching component and the resin component in the aqueous solvent, the etching promoter, and the surfactant. The immersion of the bodies 10 in the mixed solution allows surfaces of the bodies 10 to be etched. The etching of the bodies 10 is due to the action of sulfuric acid and aqueous hydrogen peroxide contained in the mixed solution.

The cationic element contained in the insulating layers 16 and 19 is ionized by etching the bodies 10. The ionized cationic element reacts with the resin component contained in the latex, that is, Nipol LATEX SX-1706 (available from ZEON Corporation), in the mixed solution. As a result, the resin component in the mixed solution is neutralized and is deposited on surfaces of the bodies 10 for use in the coil components 1, whereby the bodies 10 are covered by the coating films 14. However, the outside ends 24*a* of the coils 24 and the outside ends 26*a* of the coils 26 are not covered by the coating films 14. This is because an element contained in the coils 24 and 26 is, for example, Cu, which is nobler than the ionized cationic element, is therefore hardly ionized, and, as a result, is unlikely to react with the resin component.

Thereafter, the coating film 14 are cleaned with pure water, are drained, and are then heat-treated. The resin component contained in the coating film 14 is cross-linked with the cationic element or is cross-linked alone by the heat treatment of the coating films 14.

In Step S12, the outer electrode paste is applied to the side surfaces S2 and S3 of the bodies 10 having the coating films 14. Thereafter, the outer electrode paste applied thereto is baked at a temperature at which the coating film 14 are not pyrolyzed, whereby the outer electrodes 12*a* and the outer electrodes 12*b* are formed so as to be electrically connected to the outside ends 24*a* of the coils 24 and the outside ends 26*a* of the coils 26, respectively.

Figure 4:
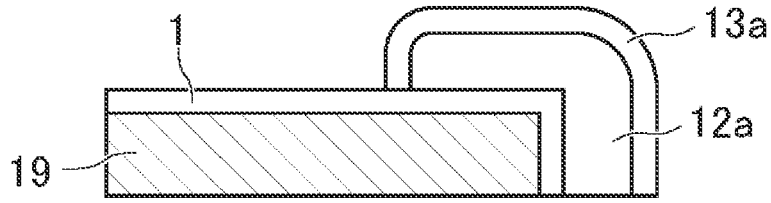
FIG. 4 is an enlarged sectional view of another outer electrode.

Next, in Step S13, the plated coatings 13*a* and 13*b* are formed on the outer electrodes 12*a* and 12*b* by the electroplating or electroless plating process. FIG. 4 is an enlarged sectional view of a section having an outer electrode 12*b* formed by Procedure 2. The coil components 1 are completed through the above steps.

(c) Procedure 3

In the case of using Procedure 3, in Step S14, the outer electrode paste is applied to the side surfaces S2 and S3 of the bodies 10 obtained in Step S7. Thereafter, the outer electrode paste applied thereto is baked, whereby the outer electrodes 12*a* and the outer electrodes 12*b* are formed so as to be electrically connected to the outside ends 24*a* of the coils 24 and the outside ends 26*a* of the coils 26, respectively.

Next, in Step S15, the plated coatings 13*a* and 13*b* are formed on the outer electrodes 12*a* and 12*b* by the electroplating or electroless plating process.

Next, in Step S16, the bodies 10 having the outer electrodes 12*a* and 12*b* and the plated coatings 13*a* and 13*b* are immersed in the mixed solution containing the commercially available latex prepared by dispersing the etching component and the resin component in the aqueous solvent, the etching promoter, and the surfactant. The immersion of the bodies 10 in the mixed solution allows surfaces of the bodies 10 to be etched. The etching of the bodies 10 is due to the action of sulfuric acid and aqueous hydrogen peroxide contained in the mixed solution.

The cationic element contained in the insulating layers 16 and 19 is ionized by etching the bodies 10. The ionized cationic element reacts with the resin component contained in the latex, that is, Nipol LATEX SX-1706 (available from ZEON Corporation), in the mixed solution. As a result, the resin component in the mixed solution is neutralized and is deposited on surfaces of the bodies 10 for use in the coil components 1, whereby the bodies 10 are covered by coating films 14.

Figure 5:
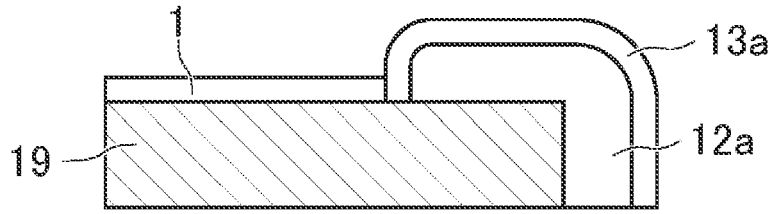
FIG. 5 is an enlarged sectional view of another outer electrode.

Thereafter, the coating film 14 are cleaned with pure water, are drained, and are then heat-treated. The resin component contained in the coating film 14 is cross-linked with the cationic element or is cross-linked alone by the heat treatment of the coating films 14. FIG. 5 is an enlarged sectional view of a section having an outer electrode 12*b* formed by Procedure 3. The coil components 1 are completed through the above steps.

The mixed solution, which is used in Procedures 1 to 3, contains the resin component, the etching component (ionizing component), and the surfactant as described above. Details of the components in the mixed solution are as described below.

The resin component is not particularly limited and may be, for example, an acrylic resin, an epoxy resin, a polyimide resin, a silicone resin, a polyamide-imide resin, a polyether ether ketone resin, a fluorinated resin, an acrylic silicone resin, or the like.

The etching component (ionizing component) is a component that ionizes a metal contained in an insulator. The etching component may be a component that ionizes at least one selected from the group consisting of Sn, Cr, Zn, Mn, Al, Mg, Ca, Ba, K, and Li. In particular, the etching component is sulfuric acid, hydrofluoric acid, iron fluoride, nitric acid, hydrochloric acid, phosphoric acid, or a carboxylic acid.

The surfactant is used as a material for regulating the thickness of the coating films 14. The surfactant used is an anionic surfactant or a nonionic surfactant and is preferably the anionic surfactant. The anionic surfactant preferably contains a sulfo group because the degree of deactivation of the anionic surfactant is adequate, the coating film 14 are likely to be formed, and the mixed solution is easy to handle. Examples of the anionic surfactant include fatty acid salts such as sodium oleate and potassium castorate, alkylsulfates such as sodium laurylsulfate and ammonium laurylsulfate, alkylbenzenesulfonates such as sodium dodecylbenzenesulfonate, alkylnaphthalenesulfonates, alkanesulfonates, dialkyl sulfosuccinates, alkyl phosphates; naphthalenesulfonic acid-formaldehyde condensates, polyoxyethylene alkylphenyl ether sulfates, and polyoxyethylene alkylsulfates. These surfactants may be used alone or in combination. Other examples of the anionic surfactant include alkylbenzenesulfonates, alkyl disulfates, alkyl diphenyl ether disulfonates, polyoxyethylene alkylphenyl ether sulfates, polyoxyethylene aryl ether sulfates, carboxylate surfactants, phosphate surfactants, naphthalenesulfonic acid-formaldehyde condensates, and polycarboxylic acid surfactants.

Examples of the nonionic surfactant include polyoxyethylene alkyl ethers containing an alkyl group such as an octyl group, a decyl group, a lauryl group, a stearyl group, or an oleyl group; polyoxyethylene alkylphenyl ethers containing an alkyl group such as an octyl group or a nonyl group; and polyoxyethylene-polyoxypropylene block copolymers. Other examples of the nonionic surfactant include water-soluble resins containing a sulfo group, a salt of the sulfo group, a carboxy group, a salt of the carboxy group, a phospho group, or a salt of the phospho group. The mixed solution may contain glycols and/or alkoxyalcohols. Glycols and/or alkoxyalcohols can inhibit development of plating on the coating film 14. Examples of the glycols include ethyleneglycol, propyleneglycol, ethyleneglycol monoalkyl ether, ethyleneglycol dialkyl ether, propyleneglycol monoalkyl ether, and propyleneglycol dialkyl ether. Examples of the glycols include alkoxymethanol, alkoxyethanol, and alkoxypropanol. The mixed solution preferably contains ethyleneglycol monobutylether and/or butoxyethanol.

In each coil component 1, the coating film 14 covering the body 10 is composed of resin and cations of a metal which is a cationic element contained in the magnetic metal powder contained in the insulating layers 16 and 19 and which has a standard electrode potential E0 of less than about 0 V. The coating film 14 is thick and is superior in abrasion resistance, insulation performance, moisture resistance, and chemical resistance to coating films formed by the chemical conversion of phosphates.

Particles contained in the magnetic metal powder contained in the insulating layers 16 and 19 are provided with insulating coatings made of a metal oxide by chemical conversion in advance. However, the insulating coatings may possibly be peeled off in a grinding step which is one of the steps of manufacturing the coil components 1. In the coil components 1, the coating film 14 covering the bodies 10 are composed of resin and the cations of the metal which is the cationic element contained in the magnetic metal powder contained in the insulating layers 16 and 19 and which has a standard electrode potential E0 of less than about 0 V and the cationic element is produced from the magnetic metal powder contained in the insulating layers 16 and 19 by ionization. Thus, even in the case where the insulating coatings are peeled off from the particles in the magnetic metal powder in the grinding step or the like, the cationic element is dissolved from the magnetic metal powder in a subsequent step and forms the coating films 14. As a result, the coil components 1 are excellent in insulation performance and rust resistance.

In addition, even in the case where the insulating coatings are peeled off from the particles in the magnetic metal powder in the grinding step or the like, the coating film 14 are formed on the magnetic metal powder in a subsequent step. This contributes to the reduction in size and profile of the coil components 1. In particular, in order to reduce the size and profile of the coil components 1, the insulating layers 16 and 19 need to be minimized in thickness. Therefore, the grinding step is essential to thin the insulating layers 16 and 19. In known electronic components, insulating layers containing a magnetic metal powder have a thickness greater than the particle size of this magnetic metal powder for fear that insulating coatings are peeled off from particles in this magnetic metal powder by chemical conversion. However, in the coil components 1, the magnetic metal powder is protected by the coating films 14; hence, the thickness of the insulating layers 16 and 19 may be less than the particle size of the magnetic metal powder. As a result, the reduction in size and profile of the coil components 1 is possible.

In the case where a resin containing the magnetic metal powder is used to form the insulating layers 16 and 19, some of the particles contained in the magnetic metal powder are removed from worked surfaces of the insulating layers 16 and 19 by working including grinding, whereby recessed portions C are formed in surfaces of bodies 10, particularly the worked surfaces of the insulating layers 16 and 19. The formation of the recessed portions C increases the area of each body 10 that is exposed to air. As a result, the insulating layers 16 and 19 are likely to absorb moisture in air. Furthermore, the formation of the recessed portions C reduces the distance between a surface of the body 10 and each of the coils 24 and 26 located in the body 10. For the above reasons, the coils 24 and 26 are likely to be corroded because of the formation of the recessed portions C. In the case where a coating film is formed by the chemical conversion of a phosphate as is the case with a known electronic component, the formed coating film is thin and therefore it is difficult to fill the recessed portions C. In the coil components 1, no coating film formed by the chemical conversion of a phosphate is used but the coating film 14 composed of resin and the cationic element dissolved from the insulating layers 16 and 19 are used. Since the coating films 14 are thicker than the coating film formed by the chemical conversion of the phosphate, the recessed portions C formed by removing particles in the magnetic metal powder can be filled. Thus, in the coil components 1, the corrosion of coils 24 and 26 can be suppressed. That is, the coil components 1 are excellent in moisture resistance.

The inventor has performed an experiment to confirm the moisture resistance of the coil components 1. In the experiment, the inventor used 50 first samples, prepared by Procedure 1 as shown in FIG. 2, corresponding to the coil components 1 and 50 second samples including coating films formed by the chemical conversion of a phosphate instead of the coating film 14 of the coil components 1. The inventor checked whether the first and second samples were normally energized at high temperature and high humidity. Particular conditions of the experiment were as follows: a current of 6 A was continuously applied to each of the first and second samples at a temperature of about 85° C.±2° C. and a humidity of about 85%±2%. After about 24 hours from the start of the experiment, the condition of each energized sample was checked. In the first and second samples, the following metal was Zn: a metal which was a cationic element contained in the coating film 14 and the coating films formed by the chemical conversion of the phosphate and which had a standard electrode potential E0 of less than about 0 V.

As a result of the experiment, two of the 50 first samples were not energized and 16 of the 50 second samples were not energized. That is, the failure rate of the first samples was about 4% and the failure rate of the second samples was about 32%. This result shows that the coating film 14 composed of the cationic element and resin in the coil components 1 are superior in moisture resistance to the coating films formed by the chemical conversion of the phosphate.

Filling the coating film 14 in the recessed portions C formed by removing particles in the magnetic metal powder contributes to the reliability of the connection between a circuit board carrying each coil component 1 and the outer electrodes 12*a* and 12*b* of the coil component 1. When the recessed portions C are present in a surface of each body 10 that is close to the outer electrodes 12*a* and 12*b*, the coating films formed by the chemical conversion of the phosphate cannot be filled in the recessed portions C. As a result, when the plated coatings 13*a* and 13*b* are provided on the outer electrodes 12*a* and 12*b*, a plating solution permeates between the body 10 and the outer electrodes 12*a* and 12*b* through the recessed portions C close to the outer electrodes 12*a* and 12*b* and therefore the outer electrodes 12*a* and 12*b* are uplifted from the body 10. Soldering an electronic component to a circuit board in this state impairs the reliability of the connection between the circuit board and the outer electrodes 12*a* and 12*b* because the adhesion of the electronic component to the circuit board is insufficient. However, in the coil component 1, the coating film 14 is filled in the recessed portions C formed by removing particles in the magnetic metal powder; hence, the reliability of the connection between the circuit board and the outer electrodes 12*a* and 12*b* can be maintained.

The inventor has performed an experiment to confirm the reliability of the connection of the coil components 1. First, the inventor prepared 50 of the first samples (prepared by Procedure 1 as shown in FIGS. 2) and 50 of the second samples. Next, the inventor soldered each sample to a circuit board, vertically erected the circuit board, and then applied force F to a side surface of the sample in a vertical downward direction. The inventor measured the force F applied to the side surface of the sample when the sample was separated from the circuit board.

As a result of this experiment, the minimum force needed to separate each of the first samples from a corresponding one of the circuit boards was about 35 N and the minimum force needed to separate each of the second samples from a corresponding one of the circuit boards was about 25 N. This result shows that the coating film 14 composed of the cationic element and resin increase the reliability of the connection between the outer electrodes 12*a* and 12*b* of the coil components 1 and circuit boards carrying the coil components 1.

On the other hand, in the coil components 1 prepared by Procedure 2 as shown in FIG. 2, after the coating film 14 are formed, the outer electrodes 12*a* and 12*b* are formed. Therefore, the coating film 14 are present between the bodies 10 and the outer electrodes 12*a*. The presence of the coating film 14 between the bodies 10 and the outer electrodes 12*a* increases the reliability of the connection between the outer electrodes 12*a* of the coil components 1 and circuit boards carrying the coil components 1. Details are described below.

As described above, in the case where the resin containing the magnetic metal powder is used to form the insulating layers 16 and 19, some of particles in the magnetic metal powder are removed from worked surfaces of the insulating layers 16 and 19 by working including grinding, whereby the recessed portions C are formed in surfaces of bodies 10. The recessed portions C are formed in, for example, the side surfaces S2 and S3 of bodies 10. In the case where the outer electrodes 12*a* and 12*b* are formed directly on the recessed portions C, the coverage of the outer electrodes 12*a* and 12*b* by the plated coatings 13*a* and 13*b* is insufficient. As a result, most of the plated coatings 13*a* and 13*b* on the recessed portions C are dissolved in solder, that is, so-called solder corrosion occurs. Upon the occurrence of solder corrosion, the outer electrodes 12*a* and 12*b* are exposed and cannot be soldered or are insufficiently soldered, whereby the reliability of the connection between the outer electrodes 12*a* of the coil components 1 and circuit boards carrying the coil components 1 is impaired.

However, in the coil components 1 prepared by Procedure 2, the coating film 14 are filled in the recessed portions C formed in the side surfaces S2 and S3 of the bodies 10 and therefore the outer electrodes 12*a* and 12*b* are sufficiently covered by the plated coatings 13*a* and 13*b*. Thus, in the coil components 1 prepared by Procedure 2, the presence of the coating film 14 between the bodies 10 and the outer electrodes 12*a* and 12*b* enables the reliability of the connection between the outer electrodes 12*a* and 12*b* of the coil components 1 and the circuit boards carrying the coil components 1 to be increased.

The inventor has performed an experiment to confirm the connection reliability of the coil components 1 prepared by Procedure 2. First, the inventor prepared 50 third samples corresponding to the coil components 1 prepared by Procedure 2. The experiment to confirm the connection reliability was similar to the experiment performed using the first and second samples. In the third samples, the following metal was Zn: a metal which was a cationic element contained in the coating film 14 and which had a standard electrode potential E0 of less than about 0 V.

As a result of this experiment, the minimum force needed to separate each of the third samples was about 35 N. As compared to the experiment result of the second samples, this result shows that the coating film 14 composed of the cationic element and resin increase the reliability of the connection between the outer electrodes 12*a* and 12*b* of the coil components 1 and circuit boards carrying the coil components 1.

An electronic component according to an embodiment of the present disclosure and a method for manufacturing the electronic component are not limited to the above embodiments and can be variously modified within the scope of the present disclosure.

In addition to the above-mentioned materials, the following materials may be added to the mixed solution for forming the coating films 14: for example, tannin, which increases corrosion resistance; a plasticizer, such as dibutyl phthalate, imparting flexibility to the coating films 14; a metal halide, such as silver fluoride, enhancing the formability of the coating film 14; and a lubricant, such as a fluorinated resin lubricant, polyolefin wax, melamine cyanurate, or molybdenum disulfide, preventing the scratching of surfaces of the coating film 14 and enhancing the water resistance of the coating films 14.

Furthermore, a pigment such as carbon black or phthalocyanine blue may be added to the mixed solution for forming the coating film 14 for the purpose of enhancing the corrosion resistance of the coating film 14 and for the purpose of coloring electronic components.

The corrosion resistance and chemical resistance of the coating film 14 can be enhanced by adding, for example, a phosphorus-containing acid group-containing polymer such as an organic polymeric compound having a main chain or side chain containing a phosphoric group, a phosphorous group, a phospho group, or a phosphinic group to the mixed solution for forming the coating films 14.

From the viewpoint of enhancing the strength, thermal conductivity, and electrical conductivity of the coating films 14, a filler such as a glass fiber, calcium carbonate, an aramid fiber, graphite, alumina, aluminium nitride, or boron nitride may be added to the mixed solution for forming the coating films 14.

In the above embodiment, the electronic component is described using the coil component as an example. The present disclosure is not limited to the coil component and can be widely applied to various electronic components, such as inductors, excluding coils.

As described above, the present disclosure is useful for an electronic component and a method for manufacturing the electronic component. In particular, in an electronic component containing an insulator containing a magnetic metal powder, a resin coating film can be formed on the insulator. An electronic component excellent in moisture resistance and chemical resistance can be obtained.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A method for manufacturing an electronic component, comprising:

preparing a body which is formed from a magnetic metal powder containing a metal having a standard electrode potential E0 of less than about 0 V and an insulator containing an insulating resin and which includes a conductor located in the insulator;

preparing a mixed solution containing an ionizing component ionizing the metal contained in the magnetic metal powder, a surfactant, and a resin component; and applying the mixed solution to the body and drying the body, wherein the surfactant is an anionic surfactant containing a sulfo group.

2. The method for manufacturing the electronic component according to claim 1, wherein the metal having the standard electrode potential E0 of less than about 0 V includes at least one selected from the group consisting of Sn, Cr, Zn, Mn, Al, Mg, Ca, Ba, K, and Li in addition to Fe.

3. The method for manufacturing the electronic component according to claim 1, wherein the insulator contains a first powder which is the magnetic metal powder and which contains Fe and a second powder containing at least one selected from the group consisting of Sn, Cr, Zn, Mn, Al, Mg, Ca, Ba, K, and Li.

4. The method for manufacturing the electronic component according to claim 1, wherein the magnetic metal powder contains a particle covered by a coating and the coating contains at least one selected from the group consisting of Sn, Cr, Zn, Mn, Al, Mg, Ca, Ba, K, and Li.

5. The method for manufacturing the electronic component according to claim 1, wherein the magnetic metal powder is a powder of an alloy or solid solution of Fe with at least one selected from the group consisting of Sn, Cr, Zn, Mn, Al, Mg, Ca, Ba, K, and Li.

6. The method for manufacturing the electronic component according to claim 1, wherein the conductor is made of a metal having a standard electrode potential E0 of about 0 V or more.

* * * * *